US007261368B1

(12) United States Patent
Clausnitzer

(10) Patent No.: US 7,261,368 B1
(45) Date of Patent: Aug. 28, 2007

(54) ERGONOMIC CHAIR

(76) Inventor: Todd Clausnitzer, 1803 E. Broadway Ave., Bismarck, ND (US) 58504

( * ) Notice: Subject to any disclaimer, the term of this patent is extended or adjusted under 35 U.S.C. 154(b) by 3 days.

(21) Appl. No.: 11/361,946

(22) Filed: Feb. 27, 2006

(51) Int. Cl.
*A47C 13/00* (2006.01)

(52) U.S. Cl. ..... 297/130; 297/112; 297/114; 297/118; 297/238; 297/423.12

(58) Field of Classification Search ..... 297/313, 297/300.1, 302.1, 325, 326, 302.3, 302.4, 297/300.4, 300.5, 112, 118, 114, 234, 235, 297/238, 254, 255
See application file for complete search history.

(56) References Cited

U.S. PATENT DOCUMENTS 2,818,911 A * 1/1958 Syak ..... 248/575
2,932,341 A * 4/1960 Morrison et al. ..... 297/296
2,949,153 A * 8/1960 Hickman ..... 297/314 X
3,599,232 A * 8/1971 Tabor ..... 248/567
4,034,948 A * 7/1977 Brownell ..... 248/585
4,607,882 A * 8/1986 Opsvik ..... 297/195.11
4,655,503 A * 4/1987 Kamijo et al. ..... 297/238
4,744,600 A * 5/1988 Inoue ..... 297/300.5
4,832,407 A * 5/1989 Serber ..... 297/423.12
4,854,641 A * 8/1989 Reineman et al. ..... 297/344.15
4,909,472 A * 3/1990 Piretti ..... 297/302.4 X
5,035,465 A * 7/1991 Hanai et al. ..... 297/238
5,080,318 A * 1/1992 Takamatsu et al. .. 297/300.1 X
5,080,435 A * 1/1992 Desanta ..... 297/316
5,150,948 A * 9/1992 Volkle ..... 297/300.5
5,505,521 A * 4/1996 Meiller et al. ..... 297/302.1
5,542,746 A * 8/1996 Bujaryn ..... 297/423.12
5,722,724 A * 3/1998 Takei et al. ..... 297/238
6,394,547 B1 * 5/2002 Vik ..... 297/298
6,619,747 B2 * 9/2003 Ko et al. ..... 297/423.12
6,663,174 B2 * 12/2003 Drage et al. ..... 297/112
6,692,075 B2 * 2/2004 Sander et al. ..... 297/316
6,811,218 B2 * 11/2004 Deimen et al. ..... 297/284.1
6,877,812 B2 * 4/2005 Congleton et al. ..... 297/353
6,966,604 B2 * 11/2005 Stumpf et al. ..... 297/300.2
7,080,885 B2 * 7/2006 Bain et al. ..... 297/354.1
7,090,303 B2 * 8/2006 Kropa ..... 297/466
7,104,606 B2 * 9/2006 Congleton et al. ..... 297/353
7,150,498 B2 * 12/2006 Svartvatn ..... 297/112
2004/0174059 A1 * 9/2004 Elzenbeck ..... 297/344.1
2005/0116519 A1 * 6/2005 Wullum ..... 297/339
2007/0040432 A1 * 2/2007 Donati ..... 297/300.2
2007/0069565 A1 * 3/2007 Diffrient ..... 297/300.5

FOREIGN PATENT DOCUMENTS

DE 4306918 A1 * 9/1994 ..... 297/118

* cited by examiner

*Primary Examiner*—Rodney B White

(57) ABSTRACT

An ergonomic seating assembly for comfortably supporting an individual during prolonged periods of time sitting in one position thereby alleviating back and neck strain and increasing productivity.

13 Claims, 6 Drawing Sheets

ERGONOMIC CHAIR

BACKGROUND OF THE INVENTION

1. Field of the Invention

The present invention relates generally to chair devices and more specifically it relates to an ergonomic seating assembly for comfortably supporting an individual during prolonged periods of time sitting in one position thereby alleviating back and neck strain and increasing productivity.

Chronic back pain is a common occurrence in today's society. With the utilization of computer and other time intensive jobs where the user must sit for hours, it is estimated that billions of dollars are lost each year because of missed work days caused by chronic back pain and other symptoms caused by an uncomfortable or incorrect chair. Hence, there is a significant need for a chair that will reduce the fatigue a user endures while sitting stationary for significant periods of time thereby increasing productivity and reducing lost productivity.

2. Description of the Prior Art

The prior art chairs are typically comprised of a seat, a backrest attached to the seat and a plurality of legs secured to the seat. For short period of utilization, the prior art conventional chair is satisfactory. However, for an individual who must sit for an extended period of time, the prior art conventional chair will cause the individual to lose proper posture thereby increasing strain upon the individual's back and shoulders.

Examples of solutions to the convention chair include U.S. Pat. No. 4,607,882 to Opsvik; U.S. Pat. No. 3,754,787 to Garber; U.S. Pat. No. 3,669,493 to Vowles; U.S. Pat. No. 4,650,249 to Serber; U.S. Pat. No. 4,832,407 to Serber; U.S. Pat. No. 4,328,991 to Mengshoel et al; U.S. Pat. No. 4,614,378 to Picou; U.S. Pat. No. 4,662,361 to Patterson; and U.S. Pat. No. 4,746,167 to Palmer et al are all illustrative of such prior art.

While these devices may be suitable for the particular purpose to which they address, they are not as suitable for comfortably supporting an individual during prolonged periods of time sitting in one position thereby alleviating back and neck strain and increasing productivity.

In these respects, the ergonomic seating assembly according to the present invention substantially departs from the conventional concepts and designs of the prior art, and in so doing provides an apparatus primarily developed for the purpose of comfortably supporting an individual during prolonged periods of time sitting in one position thereby alleviating back and neck strain and increasing productivity.

SUMMARY OF THE INVENTION

In view of the foregoing disadvantages inherent in the known types of chairs now present in the prior art, the present invention provides a new ergonomic seating assembly construction wherein the same can be utilized for comfortably supporting an individual during prolonged periods of time sitting in one position thereby alleviating back and neck strain and increasing productivity.

The general purpose of the present invention, which will be described subsequently in greater detail, is to provide a new ergonomic seating assembly that has many of the advantages of the chairs mentioned heretofore and many novel features that result in a new ergonomic seating assembly which is not anticipated, rendered obvious, suggested, or even implied by any of the prior art chairs, either alone or in any combination thereof.

To attain this, the present invention generally comprises a seat pan supported upon a helical lift, a base, an adjustable post extending from the base to the helical lift, a back/chest support adjustably attached to the seat pan by an elbow member, and a pivotal arm rest attached to the back/chest support. The base is substantially flattened for allowing the base to pass under common objects such as beds or desks without interference. The helical lift is comprised of a single piece that has a sloping track that slides upon a ball for tilting the seat pan quickly and smoothly. The pivotal arm rest is attached to the elbow member along with the back/chest support. The elbow member is attached to the helical lift wherein when the user rotates the elbow member the helical lift elevates the seat pan 15 degrees so as to enable the back/chest support to support the chest of the user. When the elbow member is rotated to its original position, the seat pan is returned to 0 degrees and the back/chest support engages the back of the user so as to act as a conventional chair.

There has thus been outlined, rather broadly, the more important features of the present invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an ergonomic seating assembly that will overcome the shortcomings of the prior art devices.

Another object of the present invention is to provide an ergonomic seating assembly that alleviates back and neck strain during prolonged periods of sitting.

An additional object of the present invention is to provide an ergonomic seating assembly that focuses support upon the cervical and upper trapezius area of the seated individual's body.

A further object of the present invention is to provide an ergonomic seating assembly that reduces carpal tunnel syndrome.

Another object of the present invention is to provide an ergonomic seating assembly that provides comfort to an individual sitting for an extended periods of time.

An additional object of the present invention is to provide an ergonomic seating assembly that makes a user more productive.

Another object of the present invention is to provide an ergonomic seating assembly that increases the number of contact points between the body and the chair.

A further object of the present invention is to provide an ergonomic seating assembly that provides for six primary contact points: the buttock on the seat pan, both feet upon the floor, the chest upon the thoracic chest rest, and the elbow/forearms upon the pivotal arm rests.

A further object of the present invention is to provide an ergonomic seating assembly that can be utilized by surgeons, computer software engineers, graphic artists, engineers, writers, goldsmiths and other professionals where sitting for prolonged periods of time is required.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE PREFERRED EMBODIMENT

Figure 1:
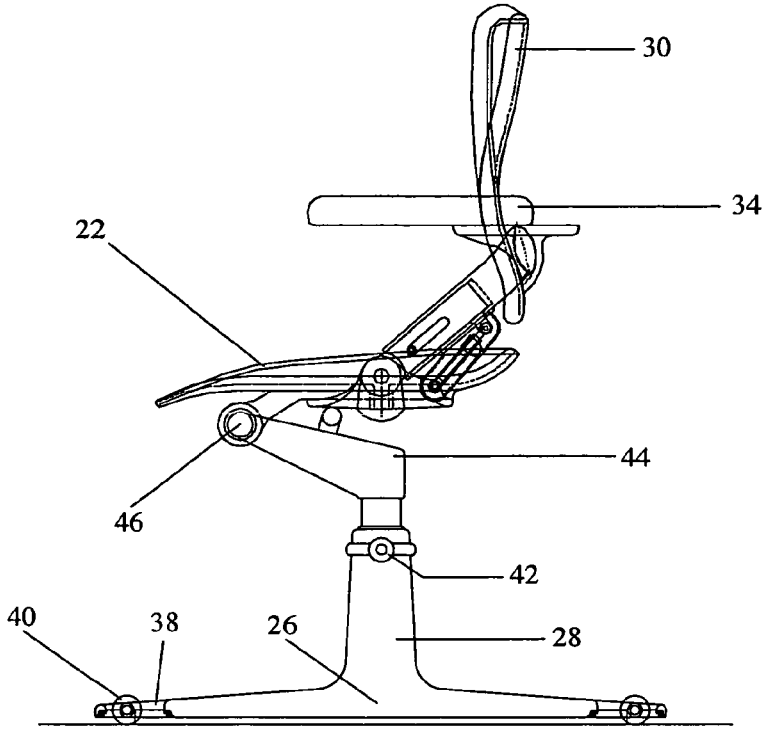
FIG. 1 is a side view of the principal embodiments of the present invention with the seat pan at 0 degrees.
Figure 2:
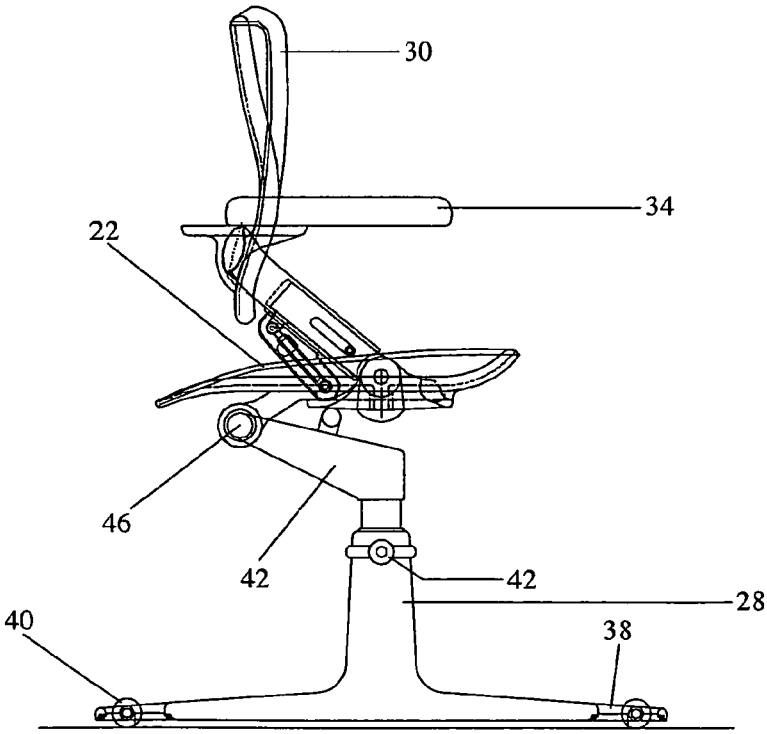
FIG. 2 is a side view of the principal embodiments of the present invention with the seat pan at 15 degrees.

Turning now descriptively to the drawings, in which similar reference characters denote similar elements throughout the several views, illustrate an ergonomic seating assembly 20, which comprises a set pan 22 supported upon a helical lift 24, a base 26, an adjustable post extending from the base 28 to the helical lift 24, a back/chest support 30 adjustably attached to the seat pan 22 by an elbow member 32, and a pivotal arm rest attached to the chest support 34. The base 26 is substantially flattened for allowing the base 26 to pass under common objects such as beds or desks without interference.

The helical lift 24 is comprised of a single piece that has a sloping track that slides upon a roller ball 36 for tilting the seat pan 22 quickly and smoothly. The pivotal arm rest 34 is attached to the elbow member 32 and the back/chest support 30. The elbow member 32 is attached to the helical lift 24.

When the user rotates the elbow member 32, the helical lift 24 elevates the seat pan 22 up to 15 degrees. As the user rotates the elbow member 32, the attached arm rest 34 and back/chest support 30 are also rotated resulting in the back/chest support 30 to be positioned so that it supports the user's chest. When the elbow member 32, along with the attached arm rest 34 and back/chest support 30 are rotated again, the seat pan 22 is returned to the 0 degree position and the back/chest support 30 engages the back of the user acting as a conventional chair.

As shown in the attached figures, the base 26 is comprised of a plurality of support arms 38 that extend radially from one another. The plurality of support arms 38 is preferable comprised of at least five support arms 38 for providing the desirable support and stability by the base 26. The support arms 38 taper in width from the center toward the distal ends. The base 26 is preferable molded into a single piece construction. The base 26 also preferably has a low profile for allowing passing under objects such as beds, cabinets and desks.

At the distal ends of the support arms 38 are a corresponding plurality of wheels 40 that are preferably hidden in a rounded cast portion of the support arms 38 for reducing interference with surrounding furniture and equipment. The plurality of wheels 40 are either caster wheels 24 or another type of wheel that allows 360 degree rotation.

As shown in the attached figures, an adjustable post 28 is secured orthogonally to the center of the base 26. The adjustable post 28 allows the user to adjust the desired height of the seat pan 22 depending upon the height of the user. The adjustable post 28 utilizes pneumatics for adjusting the height of the seat pan 22 or it may utilize other means for raising and lowering the seat pan 22. In either case, the adjustable post 28 has a locking knob 42 to lock the adjustable post 28 at the desired height. Attached to the top end of the adjustable post 28 is a chair support extension 44.

Figure 3:
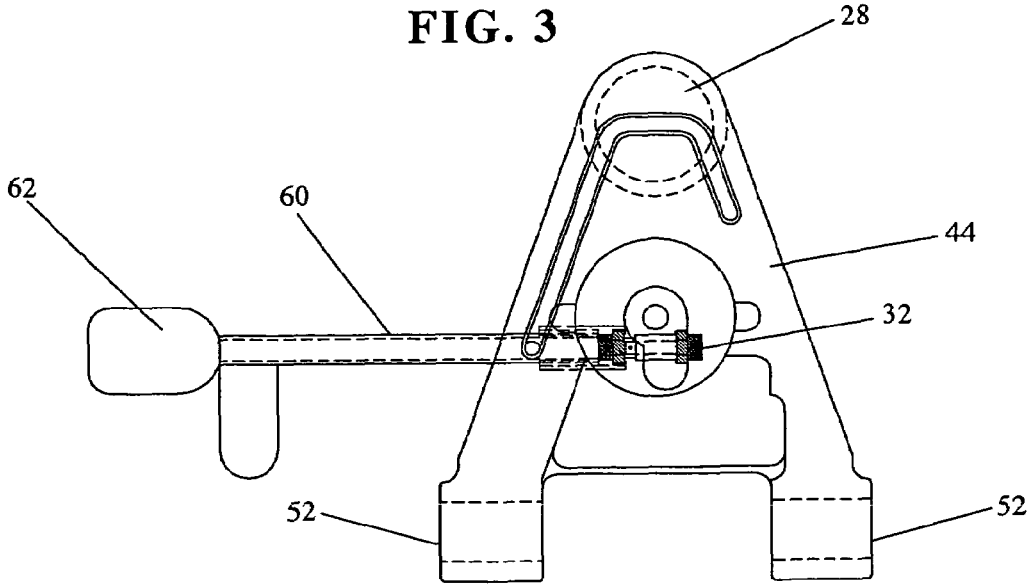
FIG. 3 is a top perspective view of the chair support extension, adjustment mechanism and handle.
Figure 4:
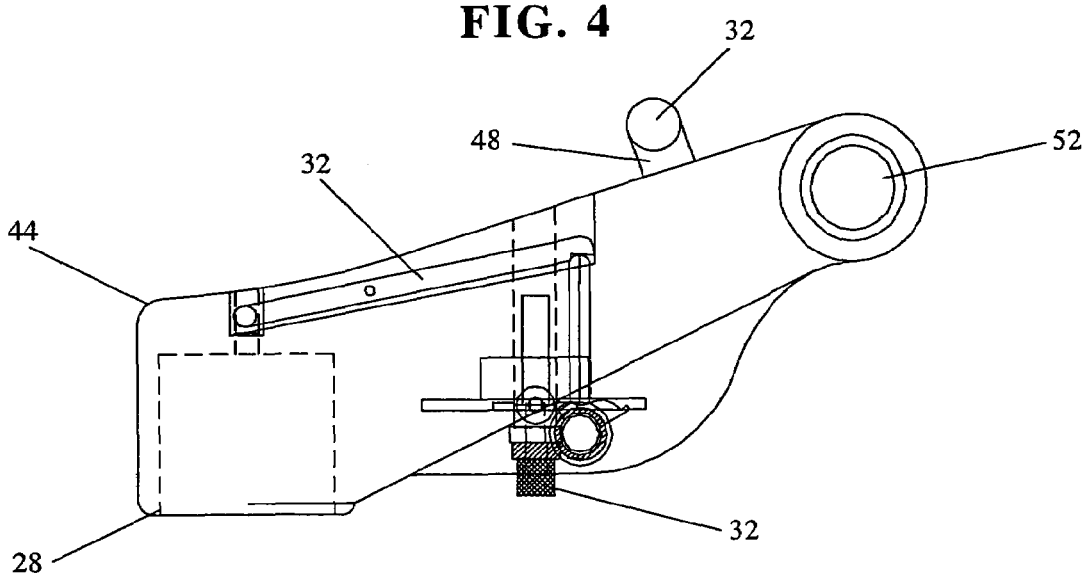
FIG. 4 is a side perspective view of the chair support extension, adjustment mechanism, cylindrical opening, cylindrical housing and roller ball.
Figure 5:
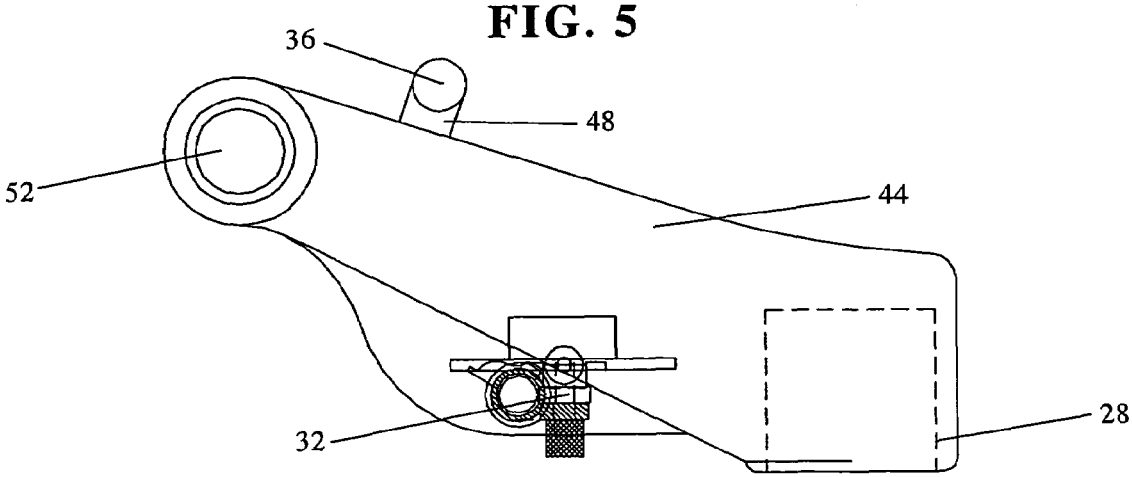
FIG. 5 is a side perspective view of the chair support extension, adjustment mechanism, cylindrical opening, cylindrical housing and roller ball.

Referring to FIGS. 3, 4 and 5, the chair support extension 44 is triangular shaped and has a first end, a second end, a top side and a bottom side. The first end of the chair support extension 44 is attached to the adjustable post 28 by a press fit or in another suitable manner. Contained within the first end of the chair support extension 44 is an adjustment mechanism 32 for raising or lowering the adjustable post 28. Attached to and extending outward from the adjustment mechanism 32 and the chair support extension 44 is a cylindrical rod 60 with a handle 62 attached to end of the cylindrical rod 60 for the user of the seating assembly 20 to easily utilize the adjustment mechanism 32.

The second end of the chair support extension 44 contains a pair of horizontal cylindrical openings 52 which cylindrical openings 52 are spaced apart so as to create a breach between the cylindrical openings 52. Fixedly attached to the top side of the chair support extension 44 is a cylindrical housing 48 for housing a roller ball 36. The roller ball 36 engages with the helical lift 24 and allows the helical lift 24, seat pan 22 and back/chest support 30 to be easily rotated.

The seat pan 22 is covered with a soft material formed to the shape of the user's buttocks for increased comfort and support. The seat pan 22 is designed with a pubic arch support to ensure comfort and support in the forward position.

Figure 6:
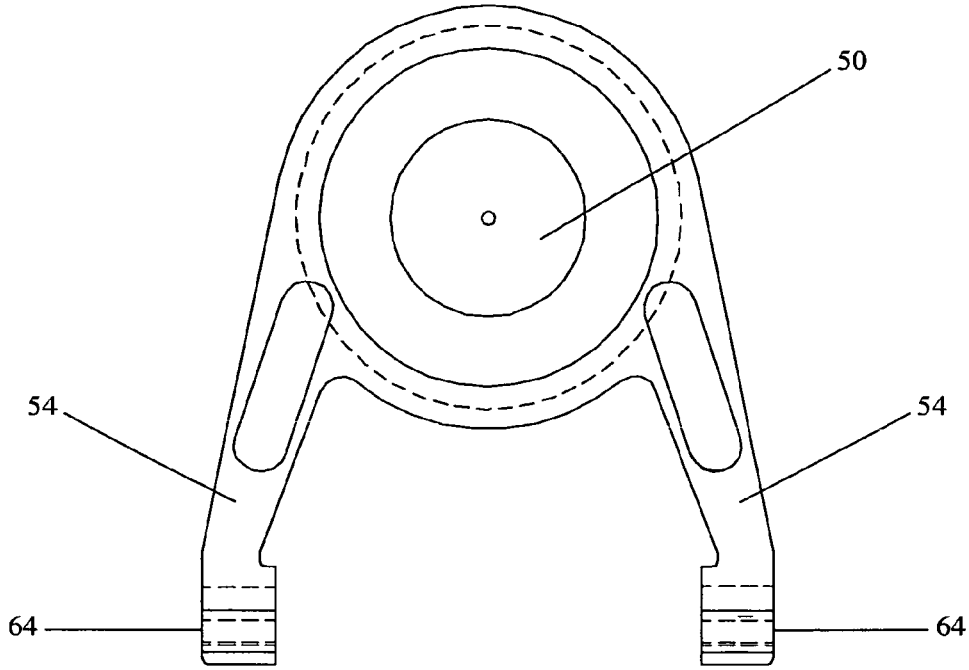
FIG. 6 is a top perspective view of the seat pan support and longitudinal extensions.
Figure 7:
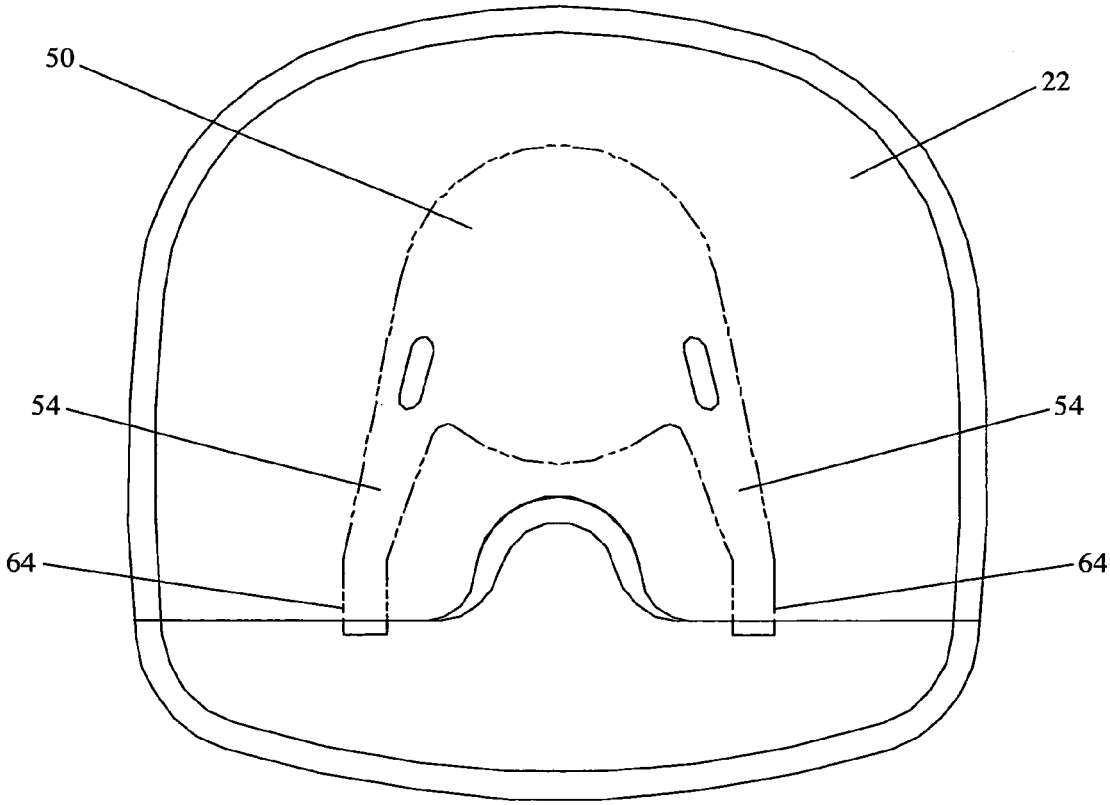
FIG. 7 is a top perspective view of the seat pan and the seat pan support.

Referring to FIGS. 6 and 7, fixedly attached to the bottom side of the seat pan 22 is a seat pan support 50. The seat pan support 50 is semi-circular with longitudinal extensions 54 extending from each side of the seat pan support 50. The ends of each longitudinal extension 54 have cylindrical openings 64. The cylindrical openings 64 of the longitudinal extensions 54 abut with the cylindrical openings 52 of the chair support extension 44 with a hinge 46 or other connection device passing through the cylindrical openings of the longitudinal extensions 54 and chair support extension 44. The hinge 46 allows the seat pan 22 to move up or down as the helical lift 24 is rotated.

Figure 8:
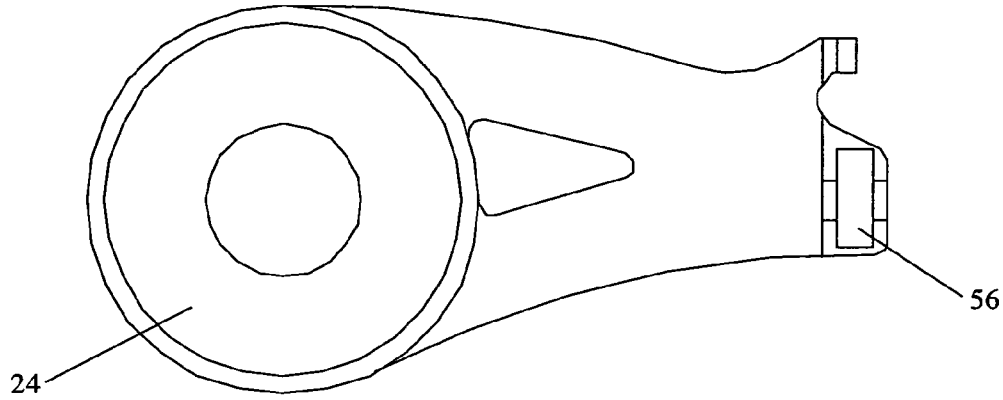
FIG. 8 is a top perspective view of the helical lift and elbow.
Figure 9:
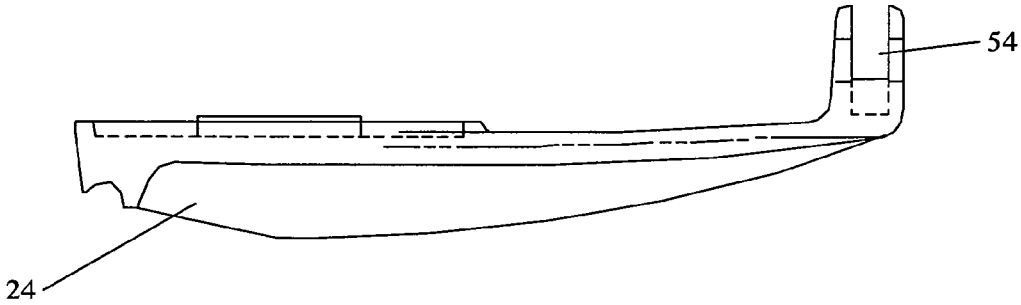
FIG. 9 is a side perspective view of the helical lift and elbow.
Figure 10:
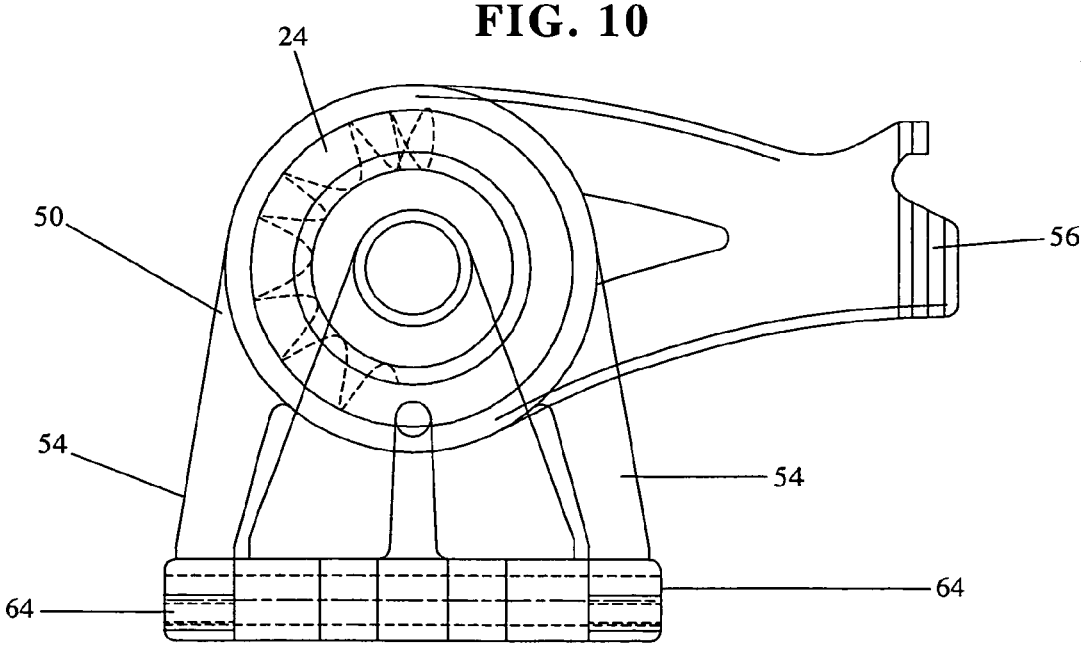
FIG. 10 is a top perspective view of the helical lift, elbow and seat pan support.
Figure 11:
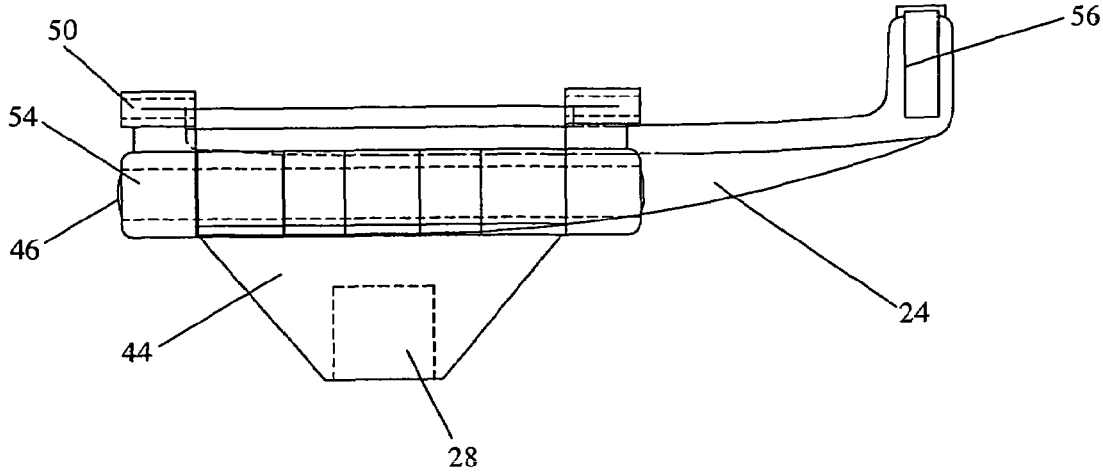
FIG. 11 is a rear perspective view of the chair support extension, helical lift and seat pan support.
Figure 12:
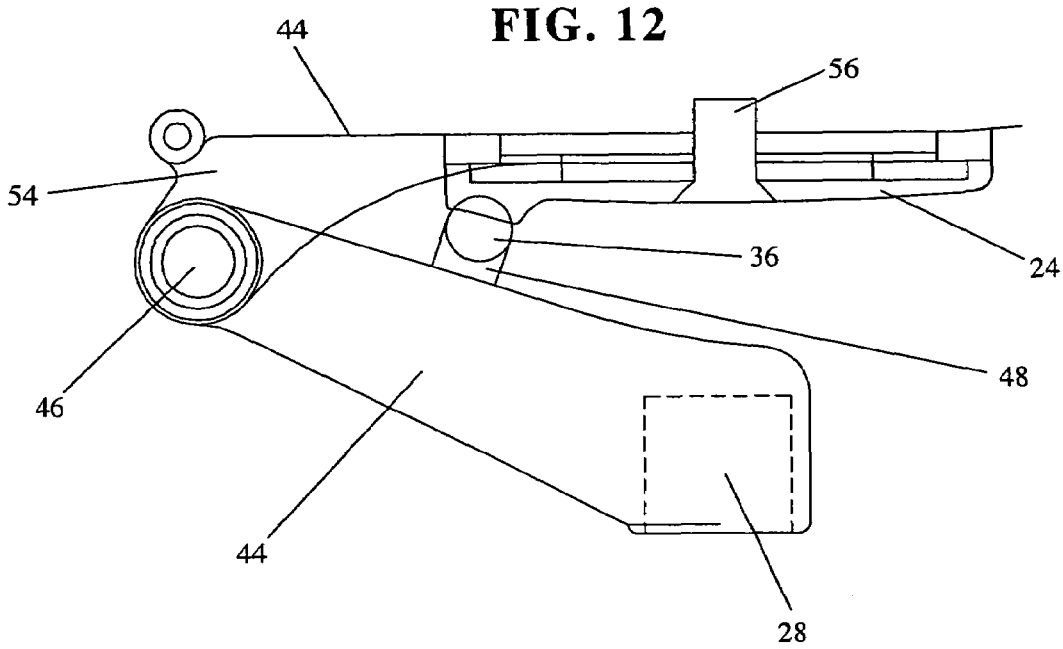
FIG. 12 is a side perspective view of the chair support extension, roller ball, cylindrical housing, helical lift, elbow, seat pan support and hinge.
Figure 13:
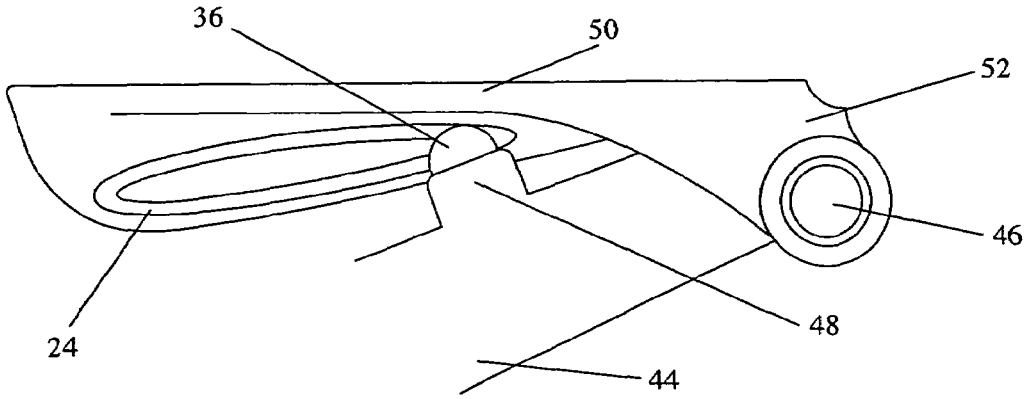
FIG. 13 is a side perspective view of the chair support extension, roller ball, cylindrical housing, helical lift, seat pan support and hinge.
Figure 14:
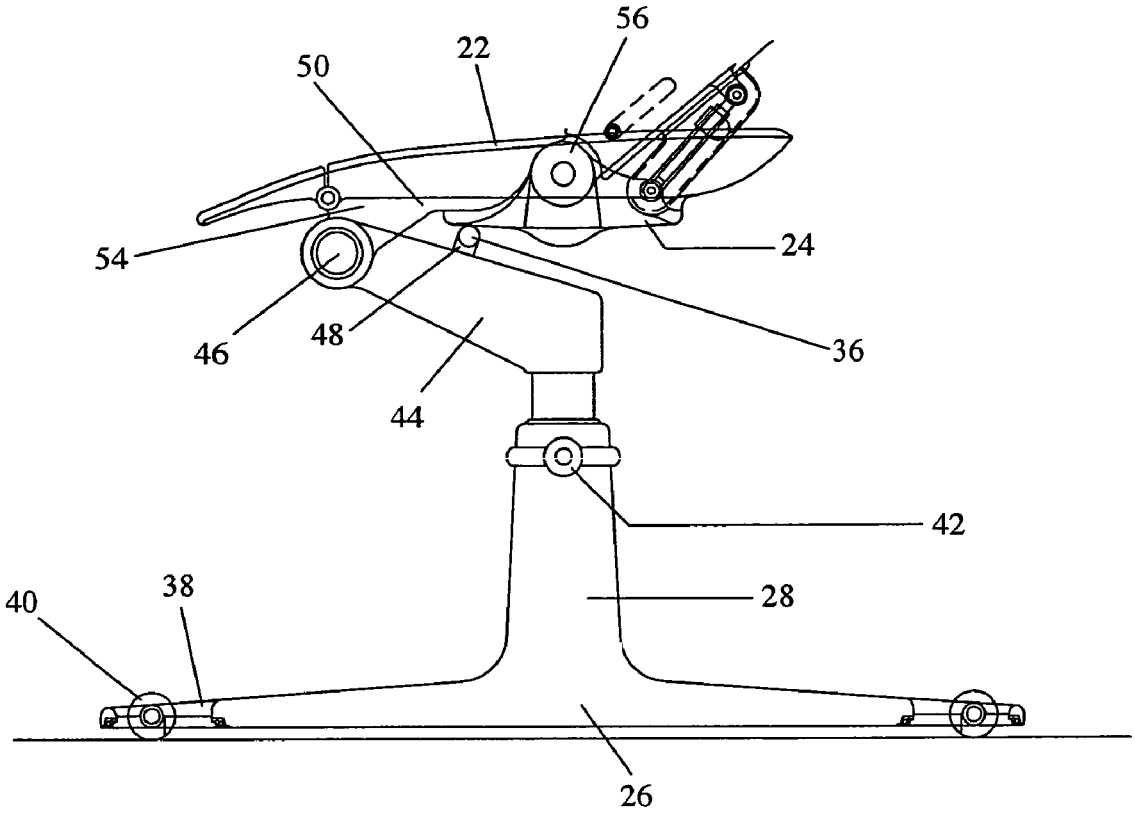
FIG. 14 is a side perspective view of the principal embodiments of the present invention

Referring to FIGS. 8, 9 and 10, the helical lift 24 is rotatably attached to the bottom side of the seat pan support 50. The helical lift 24 includes a track that slidably receives the roller ball 36 within the chair support extension 44. The track is C-shaped and has a low end and a high end. The track increases in height from the low end to the high end. When the user rotates the helical lift 24 so that the roller ball 36 goes from engaging the low end to the high end of the track, the helical lift 24 and the seat pan 22 are elevated approximately 15 degrees. When the roller ball 36 is in engagement with the low end of the track, the seat pan 22 is substantially parallel for use as a conventional chair.

As shown in FIGS. 8, 9 and 10, an elbow member 56 is fixedly attached to the helical lift 24. The elbow member 56 extends from the helical lift 24 and then is angled upwardly at an angle for supporting the back/chest support 30 and the arm rest 34. The angled vertical portion of the elbow member 56 is preferably pivotal whereby a spring assembly 58 is attached to the elbow member 56 so as to maintain the position of the elbow member 56 during utilization. The elbow member 56 is also adjustable in length for elevating or lowering the arm rests 34 and back/chest support 30.

The arm rests 34 are supported upon a platform that is attached to the distal end of the elbow member 56. The arm rests 34 are preferably pivotally adjustable for allowing adjustments into the desired position.

As further shown in the attached figures, a back/chest support 30 is attached to the distal end of the elbow member 56 for supporting the user's upper body when in the forward position. The back/chest support 30 engages the user's back when in the rearward position thereby acting as a conventional chair. The back/chest support 30 includes a bladder system that allows the user to control the contours for proper fit.

In use, the user may utilize the invention as a conventional chair with the roller ball 36 engaging the low end of the helical lift 24 whereby the seat pan 22 is substantially parallel and the back/chest support 30 is engaging the user's back. The arm rests 34 are pivoted forwardly to support the user's arms as with a conventional chair. If the user desires to utilize the invention in the forward position, the user simply rotates the elbow member 56 180 degrees so that the back/chest support 30 is in engagement with the user's upper body. When the user rotates the elbow member 56, the helical lift 24 is simultaneously rotated so that the roller ball 36 goes from the low end to the high end of the track thereby elevating the seat pan 22 forwardly. This is desirable for surgeons and other professionals who must be close to the object they are working upon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An ergonomic seating assembly comprising:

a low profile base;

an adjustable post;

a triangular shaped chair support extension having a first end, a second end, a top side and a bottom side with the first end attached to the adjustable post, the second end containing a pair of horizontal cylindrical openings which cylindrical openings are spaced apart so as to create a breach between the cylindrical openings and a cylindrical housing containing a roller ball fixedly attached to the top side of the chair support extension;

a semi-circular seat pan support having longitudinal extensions extending from each side of the seat pan support which longitudinal extensions contain cylindrical openings which cylindrical openings abut the cylindrical openings of the seat pan support;

a hinge to interconnect the abutted cylindrical openings of the longitudinal extensions and the chair support extension so as to enable the seat pan support to move up or down and remain connected to the chair support extension, adjustable post and base of the seating assembly;

a seat pan fixedly attached to the seat pan support;

a helical lift rotatably attached to the seat pan support;

an elbow member fixedly attached to the helical lift which extends from the helical lift and then is angled upwardly at an angle for supporting the back/chest support and the arm rest;

arm rests pivotally supported upon a platform that is attached to the elbow member; and a back/chest support attached to the elbow member.

2. A seating assembly as claimed in claim 1 in which the adjustable post is secured to the base to allow the user to adjust the desired height of the seating assembly.

3. A seating assembly as claimed in claim 1 in which the seat pan is covered with a soft material formed to the shape of the user's buttocks for increased comfort and support and designed with a pubic arch support to ensure comfort and support in the forward position.

4. A seating assembly as claimed in claim 1 in which the arm rests are preferably pivotally adjustable for allowing adjustments into the desired position.

5. An ergonomic seating assembly comprising:

a base;

an adjustable post;

a seat pan;

arm rests;

a back/chest support;

a triangular shaped chair support extension having a first end, a second end, a top side and a bottom side with the first end of the chair support extension attached to the adjustable post, the second end of the chair support extension containing a pair of horizontal cylindrical openings which cylindrical openings are spaced apart so as to create a breach between the cylindrical openings and a cylindrical housing containing a roller ball fixedly attached to the top side of the chair support extension;

a semi-circular seat pan support with a top side and a bottom side having longitudinal extensions extending from each side of the seat pan support which longitudinal extensions contain cylindrical openings which cylindrical openings abut the cylindrical openings of the seat pan support;

a hinge to interconnect the abutted cylindrical openings of the longitudinal extensions and the chair support extension so as to enable the seat pan support to move up or down and remain connected to the chair support extension, adjustable post and base of the seating assembly;

a helical lift rotatably attached to the seat pan support which helical lift is comprised of:

a track that slidably receives the roller ball within the chair support extension with the track being C-shaped and having a low end and a high end wherein the track increases in height from the low end to the high end;

an adjustable and pivotal elbow member fixedly attached to the helical lift that extends from the helical lift and then is angled upwardly at an angle for supporting the back/chest support and the arm rests;

when the user rotates the helical lift so that the roller ball goes from engaging the low end to the high end of the track, the helical lift and the seat pan are elevated approximately 15 degrees; and when the roller ball is in engagement with the low end of the track, the seat pan is substantially parallel for use as a conventional chair.

6. A seating assembly as claimed in claim 5 in which the base is molded into a single piece and is comprised of a plurality of support arms that extend radially from one another for providing the desirable support and stability by the base.

7. A seating assembly as claimed in claim 6 in which the base support arms accommodate wheels for supporting the chair on the floor.

8. A seating assembly as claimed in claim 5 in which the adjustable post is secured to the base and allows the user to adjust the desired height of the seat pan depending upon the height of the user.

9. A seating assembly as claimed in claim 8 in which the adjustable post has a locking knob to lock the adjustable post at the desired height.

10. A seating assembly as claimed in claim 5 in which the seat pan is designed with a pubic arch support to ensure comfort and support and is covered with a soft material formed to the shape of the user's buttocks.

11. A seating assembly as claimed in claim 5 in which the arm rests are pivotally supported upon a platform that is attached to the elbow member and are preferably pivotally adjustable for allowing adjustments into the desired position.

12. A seating assembly as claimed in claim 5 in which the back/chest support is attached to the elbow member for supporting the user's upper body when in the forward position and the user's back when in the rearward position thereby acting as a conventional chair.

13. A seating assembly containing a helical lift having a top side and a bottom side with the top side of the helical lift rotatably attached to a seat pan support which helical lift is comprised of:

a track on the bottom side of the helical lift that slidably receives a roller ball within a chair support extension with the track being C-shaped and having a low end and a high end wherein the track increases in height from the low end to the high end;

an adjustable and pivotal elbow member fixedly attached to the helical lift that extends from the helical lift and then is angled upwardly at an angle for supporting the back/chest support and the arm rests;

when the user rotates the helical lift so that the roller ball goes from engaging the low end to the high end of the track, the helical lift and the seat pan are elevated approximately 15 degrees; and when the roller ball is in engagement with the low end of the track, the seat pan is substantially parallel for use as a conventional chair.

* * * * *